US006860043B1

(12) United States Patent
Heise et al.

(10) Patent No.: US 6,860,043 B1
(45) Date of Patent: Mar. 1, 2005

(54) SHROUD FOR A DIGGING MACHINE

(76) Inventors: Ivan C. Heise, 2441 22nd Rd., Bancroft, NE (US) 68804; Carey F. Renz, 4005 Elm Rd., Bancroft, NE (US) 68804

( * ) Notice: Subject to any disclaimer, the term of this patent is extended or adjusted under 35 U.S.C. 154(b) by 7 days.

(21) Appl. No.: 10/602,204

(22) Filed: Jun. 24, 2003

(51) Int. Cl.[7] ..... E02F 5/04; E01H 5/09
(52) U.S. Cl. ..... 37/352; 37/260; 37/465
(58) Field of Search ..... 37/352, 347, 260, 37/462, 463, 464, 465

(56) References Cited

U.S. PATENT DOCUMENTS

| | | | | | |
|---|---|---|---|---|---|
| 2,817,911 | A | * | 12/1957 | Owen et al. | 37/348 |
| 3,011,278 | A | * | 12/1961 | Lust | 37/370 |
| 3,209,473 | A | * | 10/1965 | Davis | 37/352 |
| 3,398,471 | A | * | 8/1968 | Brown | 37/352 |
| 3,754,341 | A | * | 8/1973 | Caldwell et al. | 37/352 |
| 3,834,049 | A | * | 9/1974 | Bond | 37/355 |
| 4,495,716 | A | * | 1/1985 | Finan et al. | 37/3 |
| 4,650,370 | A | * | 3/1987 | Kassner et al. | 405/183 |
| 4,765,072 | A | * | 8/1988 | Schroeder | 37/465 |
| 4,827,636 | A | * | 5/1989 | Emming | 37/349 |
| 4,908,967 | A | * | 3/1990 | Leece | 37/352 |
| 5,067,263 | A | * | 11/1991 | Pelletier | 37/220 |
| 5,214,867 | A | * | 6/1993 | Weatherly et al. | 37/357 |
| 5,242,246 | A | * | 9/1993 | Manchak et al. | 405/128.85 |
| 5,245,769 | A | * | 9/1993 | Wammock | 37/357 |
| 5,930,923 | A | * | 8/1999 | Nishiguchi | 37/351 |
| 6,012,241 | A | * | 1/2000 | Pasienski et al. | 37/465 |
| 6,349,488 | B1 | * | 2/2002 | Mason | 37/94 |

* cited by examiner

*Primary Examiner*—Robert E. Pezzuto
*Assistant Examiner*—Thomas A Beach
(74) *Attorney, Agent, or Firm*—Thomte, Mazour & Niebergall; Shane M. Niebergall

(57) ABSTRACT

A shroud for digging machines is provided with a generally elongated panel of flexible material. A pair of brackets secures the opposite end portions of the panel to the frame of a digging machine, adjacent its ground engaging features. The flexible panel is positioned to receive ejected ground material and safely project it laterally from the ground engaging features to prevent the injury of individuals near the digging machine and prevent the ground material from refilling the newly formed opening in the ground. A biasing system is provided at the opposite end portions of the panel to prevent the panel from coming into contact with the ground engaging features of the digging machine.

12 Claims, 4 Drawing Sheets

SHROUD FOR A DIGGING MACHINE

BACKGROUND OF THE INVENTION

The present invention relates to accessories for digging machines, and more particularly to a shroud for use with a digging machine that is capable of providing a higher degree of safety and digging efficiency for existing digging machines.

DESCRIPTION OF THE PRIOR ART

Digging machines of various types have been known and used in the construction field for many years for digging trenches used to lay subterranean utility lines, storm sewers, and the like. The digging machines typically employ the use of a vehicle, such as a front loader, having a sturdy frame. Digging implements used on these types of machines range anywhere from the bucket-style backhoe to one of several rotary digging implements. The rotary digging implements utilize a rotating structure, such as one or more cutting discs or a chain-and-tooth system that is rotated along an elongated path. As either of these rotating structures engage the ground material, a portion of the material is removed and is projected away from the system in a generally rearward and upward direction, thus carving an open trench in the ground.

Two distinct problems exist when using rotary-type digging implements when digging a trench. First, the ground material that is propelled away from the digging implement as it rotates may typically include rocks or other sizable solid material which become dangerous projectiles to any individuals in their path. Secondly, as the digging implement rotates, substantial portions of the ground material that is excavated falls back to the ground, directly within the trench that has been dug. The crew working at the site must then use shovels or another digging machine to remove the loosened ground material from the trench.

Although rigid shields have been incorporated within digging machines to protect the operator from flying ground material, nothing has been done to prevent the return of the ground material to the trench from where it came, let alone protecting those individuals standing near the machine when it is being operated. The rigid shields are incompatible with most trencher-style digging machines having a segmented frame that is typically movable in different directions for the selection of trench depth and digging angle. Accordingly, where the frame must move with respect to itself, a rigid structure will be of little help. Although no flexible shields are known to have been used in this situation, such a structure will be difficult to use as the frame moves back and forth, causing the flexible shield to fall between the frame segments and come into contact with the rotating digging implement.

Accordingly, what is needed is shroud for use with a digging machine that provides a degree of safety from flying ground material as well as a method of keeping a substantial portion of the loosened ground material from falling into the freshly dug trench.

SUMMARY OF THE INVENTION

A shroud for digging machines is provided with a generally elongated panel having first and second end portions and opposite sides. The panel is preferably formed from a flexible material so that it may be coupled to portions of the digging machine frame that move independent from one another. A bracket is secured to the first end portion of the panel, which houses a biasing spring that movably secures the panel in an upward direction away from the ground engaging features of the digging machine. A second bracket is secured to the second end portion of the panel, which is pivotably secured to the frame of the digging machine. An additional spring member is provided for tensioning the second end portion of the panel in a generally forward direction.

In use, the panel is secured to the frame of the digging machine in such a position that it receives a substantial portion of the material removed from the ground by the ground engaging features. The position of the panel, along with its flexible characteristics, cause the ground material to be redirected laterally from the ground engaging features, thus preventing the ground material from falling into the open trench.

Accordingly, one of the principal objects of the present invention is to provide a shroud for digging machines that substantially prevents the return of ground material to the opening in the ground formed by the digging machine.

A further object of the present invention is to provide a shroud for digging machines that substantially improves the safety of individuals standing near the digging machine while it is in operation.

Still another object of the present invention is to provide a flexible shroud for use with digging machines having frame portions that move with respect to one another.

Yet another object of the present invention is to provide a flexible shroud for use with digging machines that is provided with a resilient biasing system to keep the shroud from coming into contact with the ground engaging features of the digging machine.

Still another object of the present invention is to provide a shroud for digging machines that is easily adapted for use on several different types of digging machines.

Yet another object of the present invention is to provide a shroud for digging machines that is simple in construction and use.

These and other objects will be apparent to those skilled in the art.

DESCRIPTION OF THE PREFERRED EMBODIMENT

Figure 1:
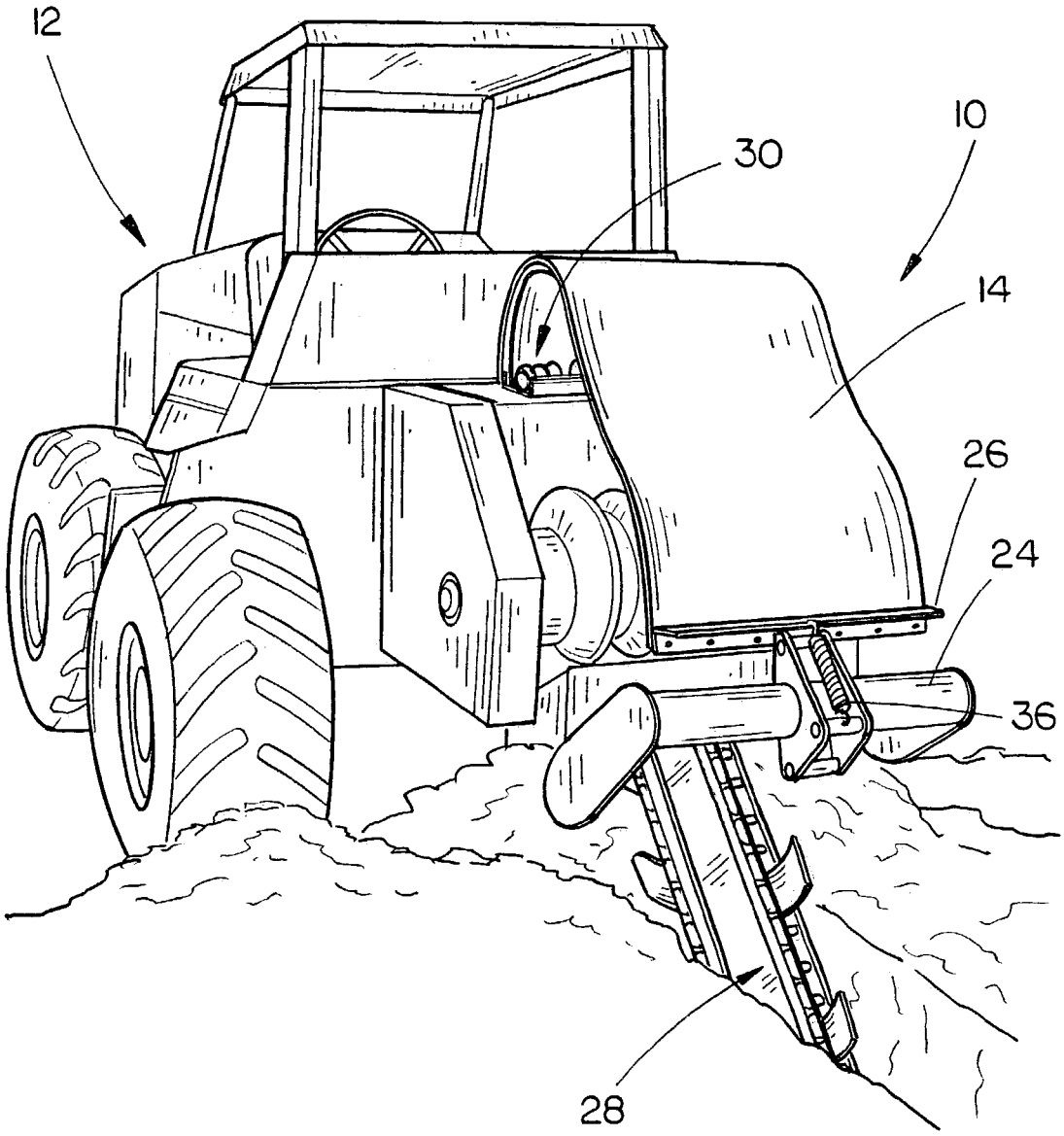
FIG. 1 is a perspective view of the shroud of the present invention as the same may be used with a trencher.
Figure 2:
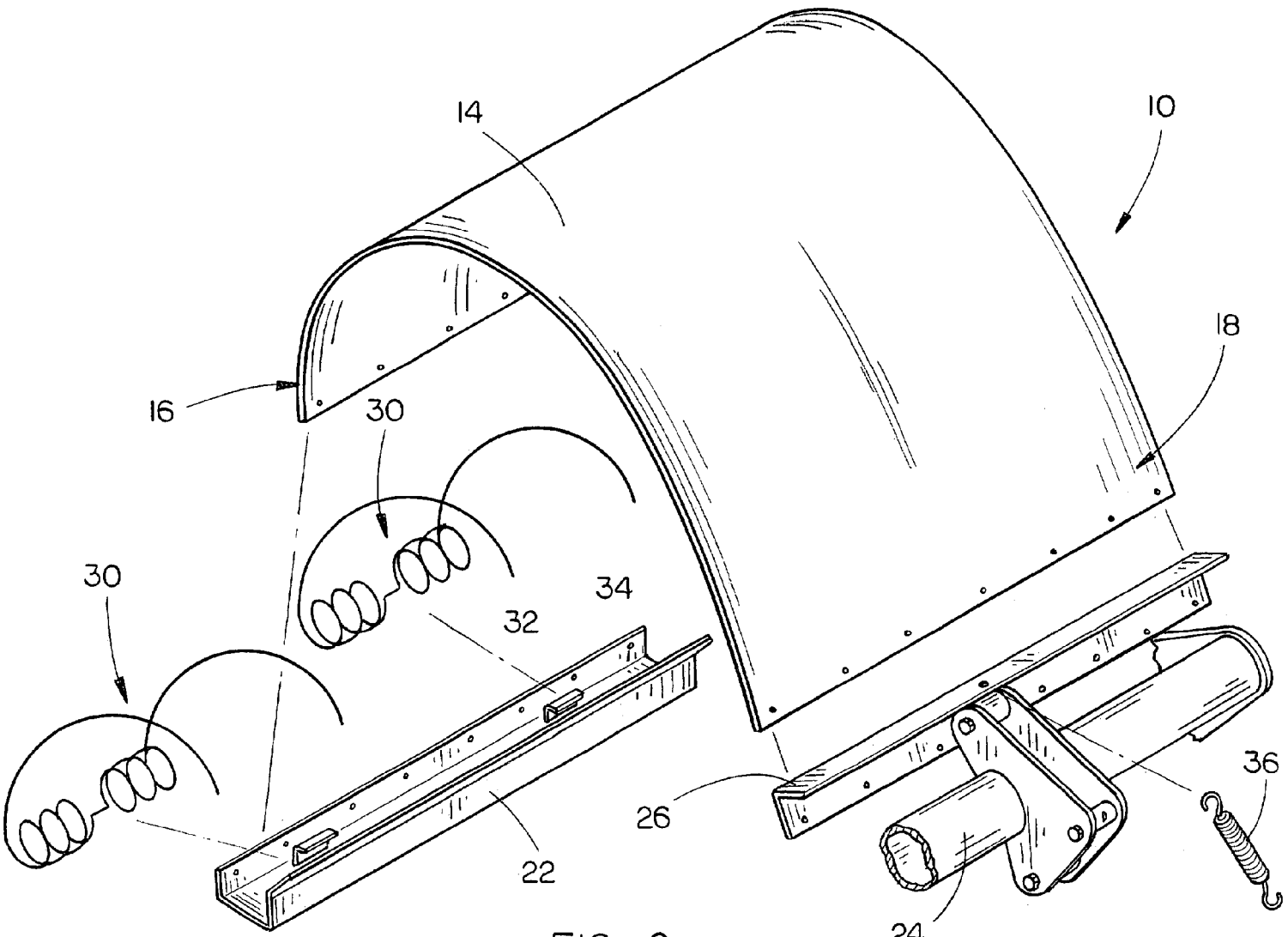
FIG. 2 is an exploded view of the shroud of the present invention.
Figure 3:
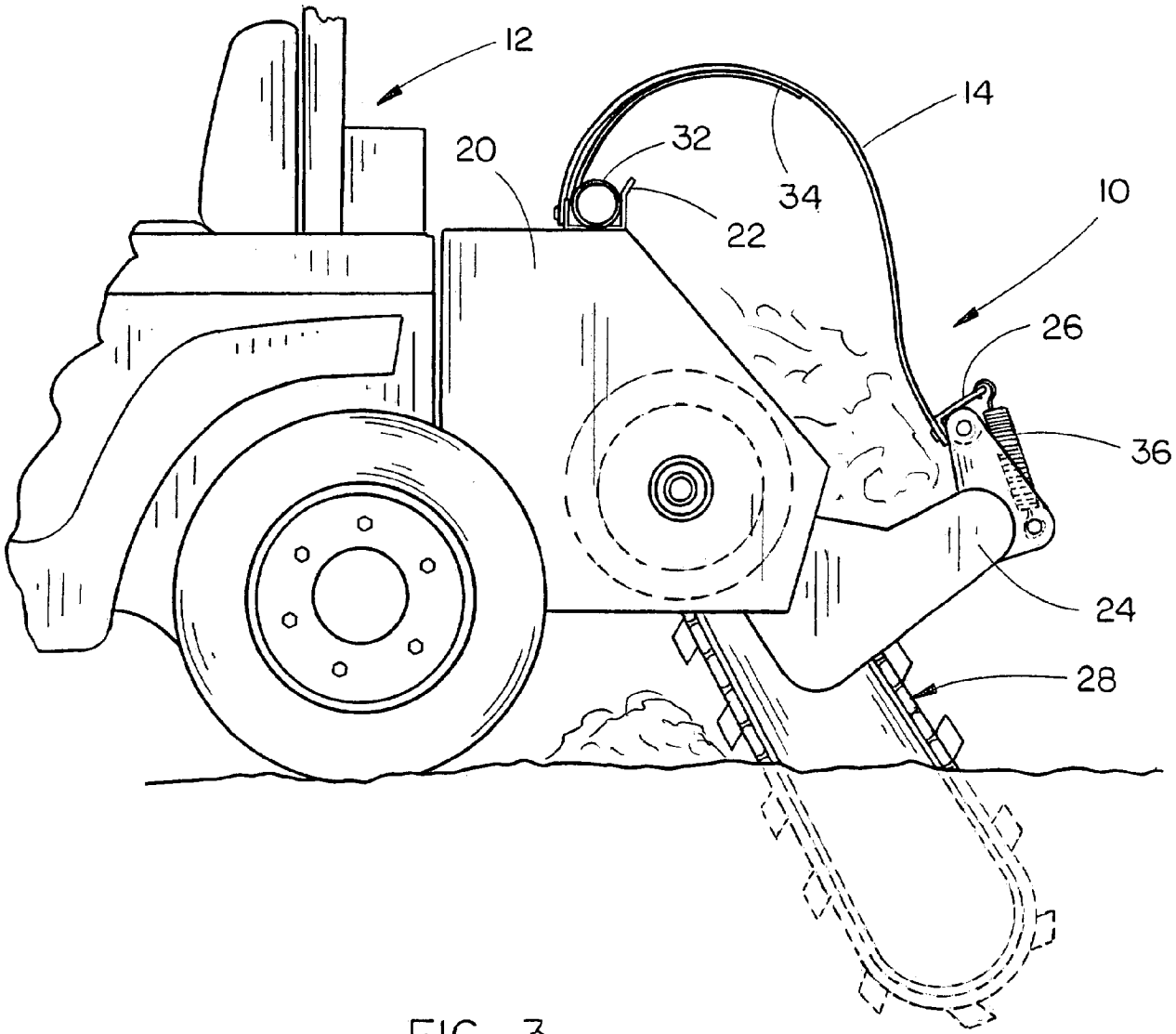
FIG. 3 is a side view of the shroud depicted in FIG. 1.
Figure 4:
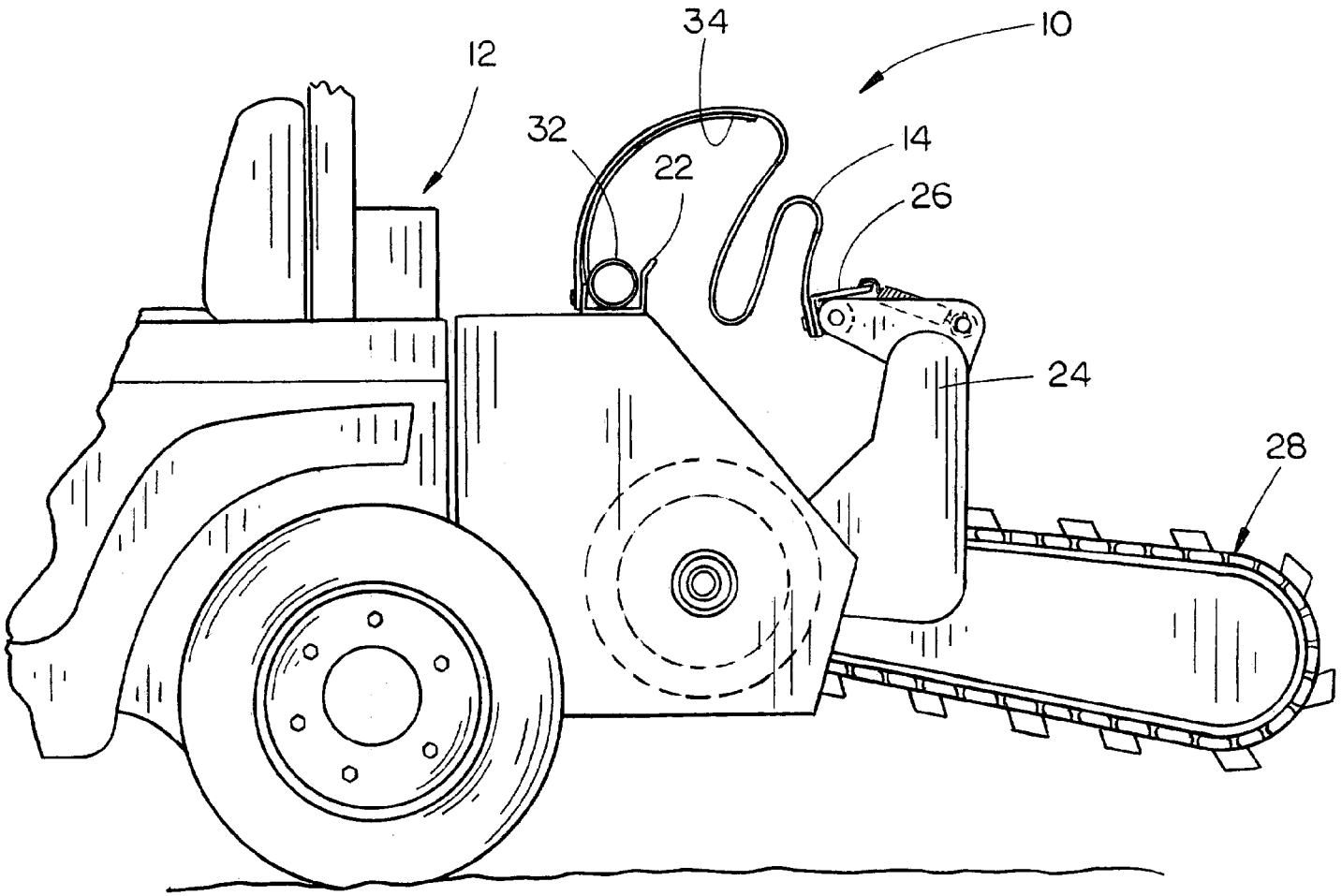
FIG. 4 is a side view of the shroud of FIG. 3 in an alternate position.

The shroud 10 of the present invention is preferably used with a digging machine 12, such as the trencher depicted in FIGS. 1, 3 and 4. However, it is contemplated that the shroud 10 of the present invention could be used with one of several different types of digging machines, including those having rotary-style ground engaging features, such as cutting discs and chain-and-tooth style cutters. It will be clear to those of skill in the art that the shroud 10 is easily adapted for use on most, if not all, digging machines. However, for simplicity, the shroud 10 will be described herein as it might be used with a trencher.

The shroud 10 is preferably comprised of a generally elongated panel 14 having a first end portion 16 and a second end portion 18. The panel 14 should be constructed of a flexible yet durable material, as will be discussed in greater detail below. The first end portion 16 of the panel 14 is preferably secured to the frame 20 of the digging machine 12 using a first bracket 22. The second end portion of the panel 14 is preferably secured to the frame 20 at its stringer 24 using a second bracket 26. The panel 14 should be provided with a width between its opposite side portions that is at least equal to or greater than the greatest width of the ground engaging feature 28.

The first bracket 22 additionally functions as a seat for the biasing springs 30, which are preferably provided with a coiled body portion 32 and elongated arm members 34. The biasing springs 30 are positioned within the first bracket 22 so that the arm members 34 are positioned adjacent the underside of the panel 14, such that the first end portion 16 is biased in a generally upward and rearward direction from the ground engaging feature 28. It is preferred, however, that the biasing springs 30 be sufficiently flexible to allow a full range of movement of the panel 14 as the stringer 24 is pivoted with respect to the frame 20.

The second bracket 26 is preferably pivotably coupled with the stringer portion 24 of the frame 20. A tensioning spring 36 is preferably engaged at one end to the second bracket 26 and at its other end to the stringer 24. The tensioning spring 36 serves to bias the second end portion 18 of the panel 14 in a generally forward direction. Accordingly, as the stringer 24 is pivoted with respect to the frame 20; as depicted in FIGS. 3 and 4, the panel 14 is substantially prevented from falling between the opening between the frame 20 and the stringer 24 and coming into contact with the ground engaging feature 28.

As the ground engaging feature 28 rotates and comes into contact with the ground, ground material will be projected in a generally rearward and upward direction. It is preferred that the panel 14 be positioned on the frame 20 to receive a substantial portion of the projected ground material. The force of the ground material striking the underside of the panel 14 and the flexible nature of the panel 14 will direct the ground material in a pair of plumes laterally from the ground engaging feature 28. Accordingly, a substantial portion of the projected ground material will fall to the sides of the newly formed opening within the ground.

It is contemplated that, where the shroud 10 must be adapted for use on a plurality of different machines having different characteristics, extensions to the first and second brackets 22 and 26 or the first and second end portions 16 and 18 of the panel 14 could be provided with extension members to increase the range of the shroud 10 in a given digging operation.

In the drawings and in the specification, there have been set forth preferred embodiments of the invention; and although specific items are employed, these are used in a generic and descriptive sense only and not for purposes of limitation.

Changes in the form and proportion of parts, as well as substitution of equivalents, are contemplated as circumstances may suggest or render expedient without departing from the spirit or scope of the invention as further defined in the following claims.

Thus it can be seen that the invention accomplishes at least all of its stated objectives.

We claim:

1. A shroud for a digging machine having at least a frame and a rotating ground engagement feature, comprising:

a flexible panel having first and second end portions and opposite side portions;

said first and second end portions being operatively coupled to the frame adjacent the rotating ground engagement feature;

said panel having a width extending between said opposite side panels that is at least equal to a greatest width of the ground engagement feature; and a spring operatively coupled to the first end portion of said panel so that said first end portion is biased in a generally upward direction away from the ground engagement feature.

2. The shroud of claim 1 further comprising a second spring operatively connected to the second end portion of said panel and the frame so that said second end portion is biased in a generally forward direction.

3. The shroud of claim 2 further comprising a mounting bracket operatively connected to the second end portion of said panel and operatively pivotably coupled to the frame.

4. The shroud of claim 3 wherein said second spring engages a portion of said mounting bracket.

5. The shroud of claim 1 wherein the ground engagement feature is capable of projecting ground material in a generally upward and rearward direction; said panel being positioned to deflect a substantial portion of said ground material laterally with respect to the ground engagement feature.

6. In combination:

a digging machine having a mobile frame and ground engagement means rotatably coupled to said frame for excavating portions of ground material;

a flexible panel having first and second end portions operatively coupled to said frame adjacent said ground engagement means;

said panel having a width that is at least equal to a greatest width of said ground engagement means; and a tensioning spring operatively connected to the second end portion of said panel and said frame so that said second end portion is biased in a generally forward direction.

7. The combination of claim 6 wherein said ground engagement means is capable of projecting said portions of ground material in generally upward and rearward directions; said panel being positioned with respect to said ground engagement means to deflect a substantial portion of said portions of ground material laterally with respect to said ground engagement means.

8. The combination of claim 6 further comprising a mounting bracket operatively connected to the second end portion of said panel and operatively pivotably coupled to said frame.

9. The combination of claim 8 wherein said second spring engages a portion of said mounting bracket.

10. In combination:

a digging machine having a mobile frame and ground engagement means rotatably coupled to said frame for excavating portions of ground material;

a flexible panel having first and second end portions operatively coupled to said frame adjacent said ground engagement means;

said panel having a width that is at least equal to a greatest width of said ground engagement means; and a biasing spring operatively coupled to the first end portion of said panel and said frame so that the first end portion of said panel is biased in a generally upward direction away from said ground engagement means.

11. The combination of claim 10 further comprising a spring seat coupled to said frame to operatively receive the first end portion of said panel and said biasing spring.

12. In combination:

a digging machine having a mobile frame and ground engagement means rotatably coupled to said frame for excavating portions of ground material;

a flexible panel having first and second end portion operatively coupled to said frame adjacent said ground engagement means;

said panel having a width that is at least equal to a greatest width of said ground engagement means; and means for generally biasing said panel away from said ground engagement means.

* * * * *